US011578390B2

(12) United States Patent
Guesser et al.

(10) Patent No.: US 11,578,390 B2
(45) Date of Patent: Feb. 14, 2023

(54) GRAY CAST IRON ALLOY, AND INTERNAL COMBUSTION ENGINE HEAD

(71) Applicant: TUPY S.A., Joinville (BR)

(72) Inventors: Wilson Luiz Guesser, Joinville (BR); Eder dos Reis Silva, Joinville (BR); Ivo Baumer, Joinville (BR); Carlos de Souza Cabezas, Joinville (BR)

(73) Assignee: Tupy S. A., Joinville (BR)

( * ) Notice: Subject to any disclaimer, the term of this patent is extended or adjusted under 35 U.S.C. 154(b) by 0 days.

(21) Appl. No.: 16/975,454

(22) PCT Filed: Nov. 12, 2018

(86) PCT No.: PCT/BR2018/050415
§ 371 (c)(1),
(2) Date: Aug. 25, 2020

(87) PCT Pub. No.: WO2019/161463
PCT Pub. Date: Aug. 29, 2019

(65) Prior Publication Data

US 2021/0017633 A1 Jan. 21, 2021

(30) Foreign Application Priority Data

Feb. 26, 2018 (BR) ..... BR1020180037935

(51) Int. Cl.
*C22C 37/06* (2006.01)
*C22C 33/08* (2006.01)
*F02F 1/24* (2006.01)

(52) U.S. Cl.
CPC ..... *C22C 37/06* (2013.01); *C22C 33/08* (2013.01); *F02F 1/24* (2013.01); *C21D 2211/009* (2013.01)

(58) Field of Classification Search
CPC combination set(s) only.
See application file for complete search history.

(56) References Cited

U.S. PATENT DOCUMENTS 4,435,226 A 3/1984 Neuhauser et al. ..... 148/3
7,083,685 B1 * 8/2006 Katori ..... C22C 37/10 148/321

(Continued)

FOREIGN PATENT DOCUMENTS

BR PI0408346 A 3/2006
BR PI 0105987-4 B1 8/2009

(Continued)

OTHER PUBLICATIONS

Ankamma, Kandula. "Effect of Bismuth in Trace Level on the Properties of Gray Cast Iron", International Journal of Engineering Sciences & Research Technology, 2(8), Aug. 2013, p. 2166-2169 (Year: 2013).*

Wang,Guang-hua, et al., "Thermal conductivity of cast iron—A review", Special Review, China Foundry, Vo. 17, No. 2, Mar. 2020, pp. 85-95.

(Continued)

*Primary Examiner* — Anthony J Zimmer
*Assistant Examiner* — Ricardo D Morales
(74) *Attorney, Agent, or Firm* — Harrington & Smith

(57) ABSTRACT

The present invention refers to a gray cast iron alloy with chemical composition especially developed to promote high hot mechanical strength and good thermal conductivity, with antimony and nitrogen contents, wherein the antimony content ranges from 0.05 to 0, 12% by weight, and the nitrogen content ranges from 0.008 to 0.013% by weight, based on the total weight of the gray cast iron alloy.

2 Claims, 1 Drawing Sheet

(56) References Cited

U.S. PATENT DOCUMENTS

| | | | | |
|---|---|---|---|---|
| 7,163,594 | B1 | 1/2007 | Tandon et al. | 148/321 |
| 2006/0008377 | A1 | 1/2006 | Eriksson et al. | |
| 2008/0206584 | A1 | 8/2008 | Jaszarowski et al. | |

FOREIGN PATENT DOCUMENTS

| | | | |
|---|---|---|---|
| BR | PI 1015989-0 | B1 | 8/2009 |
| CN | 1176315 | A | 3/1998 |
| CN | 101748325 | A | 6/2010 |
| JP | 1068042 | A | 3/1998 |
| RU | 2332499 | C1 | 8/2008 |
| RU | 2491363 | C2 | 8/2013 |
| WO | WO 2004/083474 | A1 | 9/2004 |

OTHER PUBLICATIONS

Krause, D.E., "Gray Iron—A Unique Engineering Material", Gray, Ductile, and Malleable Iron Castings—Current Capabilities, ASTM STP 455, American Society for Testing and Materials, Sep. 1990, 26 pages.

"Vanadium in cast irons", BCIRA Bradsheet 228, BCIRA Journal, Mar. 1982, 3 pages.

Stuewe, L., et al., "Influence of chromium andmolybdenum in solidification and shrinkage defects for high resistance prey iron alloys", 10th International Symposium on the Science and Processing of Cast Iron—SPC110, Nov. 13, 2014, 9 pages.

Stuewe, Luciana, "Master's Dissertation", https://teses.usp.br/teses/disponiveis/3/3133/tde-09022009-173733/en.php, Oct. 17, 2022, 2 pages.

* cited by examiner

GRAY CAST IRON ALLOY, AND INTERNAL COMBUSTION ENGINE HEAD

CROSS REFERENCE TO RELATED APPLICATION

This patent application is a U.S. National Stage application of International Patent Application Number PCT/BR2018/050415 filed Nov. 12, 2018, which is hereby incorporated by reference in its entirety, and claims priority to BR1020180037935 filed Feb. 26, 2018.

FIELD OF THE INVENTION

The present invention refers to a gray cast iron alloy with a chemical composition especially developed to promote high hot mechanical strength associated with good thermal conductivity. The present invention also refers to the application of said alloy to an internal combustion engine head.

BASIS OF THE INVENTION

As is well known in the state of the art, the demand for high mechanical strength cast materials has been intense in the automotive industry, aiming at reducing the weight of automotive vehicles, increasing engine power and reducing gas emissions.

The properties of the engine heads are particularly influenced by the compositions of the iron alloys that constitute them, since they have requirements of specific mechanical properties, and high stability at high temperatures.

Many advances have been made, for example, vermicular cast iron alloys (as exemplified in documents PI 0105989-0 and PI 0105987-4). The vermicular cast iron alloys have high mechanical properties, however they involve sophisticated production processes, in both casting and machining, which makes the manufacturing cost relatively high compared to gray cast iron.

In addition, vermicular cast iron alloys imply restrictions on the use of carbide stabilizer alloying elements, which limits the attainment of high strength and the stability of the hot microstructure.

Another factor to be considered is the lower thermal conductivity of the vermicular irons compared to the gray irons, due to the difference in graphite form, which brings restrictions of application of the vermicular irons to parts wherein the thermal conductivity is an important requirement, which is the case of internal combustion engine heads.

Alternatively, document U.S. Pat. No. 7,163,594 exemplifies a high mechanical strength gray cast iron composition, wherein a brake drum is produced with a gray cast iron alloy containing from 4.10 to 4.25% carbon equivalent; from 3.5 to 3.65% carbon; from 0.4 to 0.9% manganese; from 1.5 to 1.9% silicon; up to 0.12% phosphorus; up to 0.17% sulfur; from 0.6 to 0.8% molybdenum; and from 0.3 to 0.6% copper. This alloy contains high contents of molybdenum, which is favorable to the provision of good mechanical properties, but results in difficulties in obtaining parts free of shrinkage porosities, particularly in complex geometry parts, such as engine heads and engine blocks.

Specifically for blocks and engine heads, it is also possible to exemplify the solution proposed in the document PI 0408346-6, which discloses a gray cast iron containing from 0.0095 to 0.0160% of nitrogen associated with from 0.05 to 0.15% tin. This alloy, in principle, would present good levels of mechanical properties. However, the use of tin as an alloying element brings a significant reduction in the machinability property, since it is well known the detrimental effect of this chemical element, which segregates for cell contours and causes a pronounced decrease of the interlamellar spacing of the pearlite, which results in a pronounced decrease of the machinability.

In the specific case of internal combustion engine blocks and heads, machinability is an important property that is reflected in the cost of the product, since these parts are often machined extensively until the final product is obtained.

Another possibility commonly employed for engine heads is the use of gray cast iron bound to chromium and molybdenum, with reasonable values of hot strength and microstructure stability. However, the increase in the temperature of the combustion gases in the new engines shows that this technique is no longer appropriate for the new situations. The increase of the molybdenum content for up to 0.35% partially solves the problem by increasing the hot strength to a certain extent without, however, applying a definitive solution.

High molybdenum contents increase the tendency for forming shrinkage porosities, which may be a limiting factor to this solution, depending on the complexity of the cast part. Moreover, this increase in the molybdenum content results in a considerable increase in the production costs of the alloys, in addition to markedly decrease the working life of the machining tools due to the presence of high hardness intercellular molybdenum carbides. Another factor to be considered is that the presence of chromium and molybdenum at high levels decreases the thermal conductivity of gray iron, which represents a disadvantage for this approach.

Finally, the scientific paper "Gray Iron—A Unique Engineering Material" (D. E. Krause; Iron Casting Research Institute, 1969), discusses the properties and advantages of gray iron alloys, and it discloses an alloy comprising nitrogen and antimony contents. However, the disclosed contents are extremely low, and they are not sufficient to result in the properties required for internal combustion engine heads.

It is noticed, therefore, that in the present state of the art there is still a demand for new compositions of cast iron alloys, which have the properties suitable for the manufacture of internal combustion engine heads. It is from this scenario that the invention in question arises.

OBJECTS OF THE INVENTION

Therefore, the present invention is basically aimed at solving the problem of the provision of a gray cast iron alloy having high hot mechanical strength associated with good thermal conductivity values.

It is also an object of the present invention to provide an internal combustion engine head having properties of high strength and stability at high temperatures, as well as good thermal conductivity.

SUMMARY OF THE INVENTION

All the objects of the invention in question are achieved by means of the gray cast iron alloy, which has a chemical composition with antimony and nitrogen contents, wherein the antimony content ranges from 0.05 to 0.12% by weight, and the nitrogen content ranges from 0.008 to 0.013% by weight, based on the total weight of the gray cast iron alloy.

In a preferred embodiment, the iron alloy further comprises contents of at least one of the following elements: carbon, phosphorus, silicon, manganese, sulfur, chromium, copper, tin, molybdenum and iron.

In another preferred embodiment, the iron alloy comprises a chromium content ranging from 0.05 to 0.25% by weight, based on the total weight of the gray cast iron alloy.

In another preferred embodiment, the iron alloy comprises copper content ranging from 0.01 to 0.95% by weight, based on the total weight of the gray cast iron alloy.

In another preferred embodiment, the iron alloy comprises tin content ranging from 0.01 to 0.12% by weight, based on the total weight of the gray cast iron alloy.

In another preferred embodiment, the iron alloy comprises molybdenum content ranging from 0.03 to 0.30% by weight, based on the total weight of the gray cast iron alloy.

The present invention also refers to an internal combustion engine head made of gray cast iron alloy, as defined above.

BRIEF DESCRIPTION OF THE DRAWINGS

The preferred embodiment of the invention in question is described in detail based on the listed figures, which have a character merely illustrative and non-limiting, since adaptations and modifications may be made without thereby departing from the scope of the claimed protection.

DETAILED DESCRIPTION OF THE INVENTION

As described above, the present invention refers to a gray cast iron alloy with chemical composition especially developed to promote high hot mechanical strength and good thermal conductivity.

The gray cast iron alloy of the present invention exhibits a chemical composition with antimony and nitrogen contents, which distances itself from the traditional compositions of the state of the art.

More specifically, the antimony content ranges from 0.05 to 0.12% by weight, and the nitrogen content ranges from 0.008 to 0.013% by weight, based on the total weight of the gray cast iron alloy.

Preferably, the iron alloy further comprises contents of at least one of the following elements: carbon, phosphorus, silicon, manganese, sulfur, chromium, copper, tin, molybdenum and iron.

If present, the chromium contents range from 0.05 to 0.25% by weight, the copper contents range from 0.01 to 0.95% by weight, the tin contents range from 0.01 to 0.12% by weight, and the molybdenum contents range from 0.03 to 0.30% by weight, based on the total weight of the gray cast iron alloy.

Figure 1:
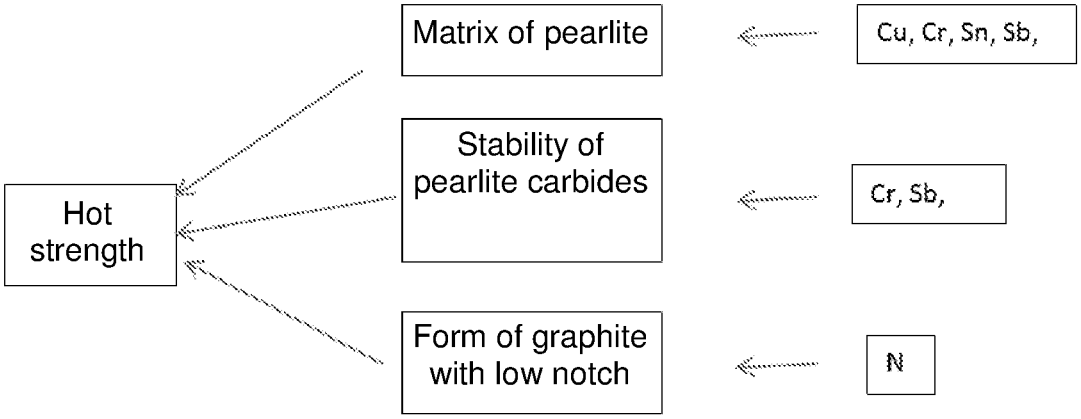
FIG. 1 is a diagram illustrating the relations required to obtain good hot strength values in gray cast irons.

FIG. 1 shows the relations required to obtain good values of hot strength in gray cast irons. A pearlitic matrix is required, the presence of graphite particles (veins) of small size and with suitable shape. In addition, the pearlitic matrix must be thermodynamically or kinetically stabilized, otherwise decomposition of pearlite carbide occurs, with consequent decrease in mechanical strength.

The contribution of each element of the chemical composition of the gray cast iron alloy of the present invention to this hot property is indicated in FIG. 1.

More specifically, the amount of nitrogen is related to the form of graphite with low notch, the amounts of chromium and antimony relate to the stability of pearlite carbides, and the amounts of copper, chromium, tin and antimony relate to the matrix of pearlite.

The three characteristics together affect the hot strength of the gray cast iron alloy. This is achieved, in the present invention, with low contents of alloying elements, which maximizes the thermal conductivity of the gray iron.

The present invention refers to a new gray cast iron alloy with a combination of traditional alloying elements such as carbon, manganese, sulfur, silicon, phosphorus, chromium, tin, copper and molybdenum, and controlled contents of antimony and nitrogen in combination such that it allows obtaining high levels of hot mechanical properties, good stability of the hot microstructure, and good thermal conductivity values.

This combination of alloying elements allows obtaining a gray cast iron with levels of tensile strength limit of from 250 to 350 MPa at room temperature, and tensile strength limit of from 180 to 280 MPa at 400° C., depending on thickness of the section wherein such property is referred. With these mechanical strength levels, it is not necessary to employ vermicular cast irons for a number of applications, which results in products that are more economical and with higher thermal conductivity.

Figure 2:
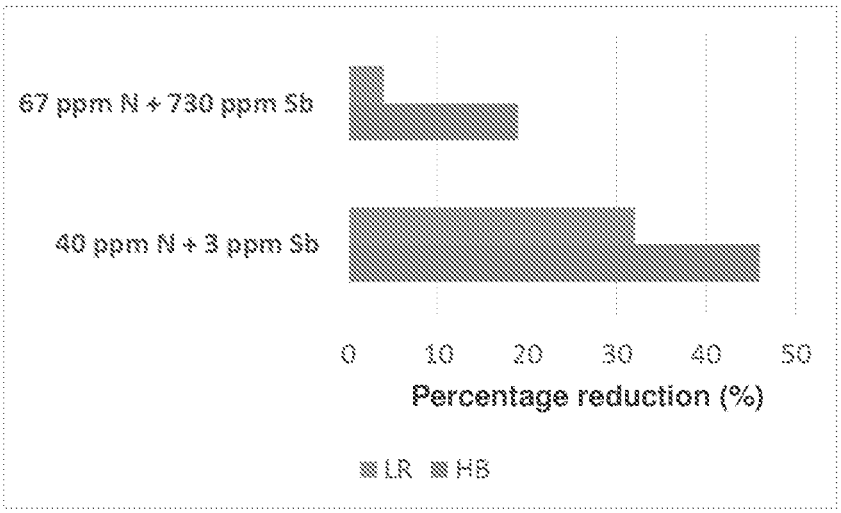
FIG. 2 illustrates a graph relating the drop of Hardness (HB) and Tensile Strength Limit (LR) with exposure of gray iron alloys for 96 h at 705° C.

The gray cast iron bound to nitrogen and antimony, object of the present invention, also has an extremely important property, which is the thermal stability of the microstructure, so that the strength does not suffer marked decreases in hot work, a typical condition of some components of internal combustion engines. FIG. 2 illustrates this behavior, verifying that increasing contents of nitrogen and antimony decrease the hardness and strength drop by exposure to high working temperatures.

In addition, the combination of the alloying elements enables a good machinability matrix to be obtained, which for internal combustion engine heads is a critical factor, given the large amount of machining these components need to suffer in their production, in particular in milling and drilling operations.

In order to obtain this set of properties, the combination of contents of chemical element is such that the antimony content is between 0.05 to 0.12% by weight, and the nitrogen content between 0.008 to 0.013% by weight, in relation to the total weight of the gray cast iron alloy. Such concentrations are higher than those found in the state of the art.

Thus, the present invention of cast irons bound to antimony and nitrogen, especially at specific concentrations, allows the development of superior performance engine heads, suitable for high engine operating temperatures.

In this regard, the present invention also refers to an internal combustion engine head, made of gray cast iron alloy, as defined above.

It is important to highlight that the above description is for the sole purpose of describing in an exemplifying manner the particular embodiment of the invention in question. It is therefore clear that modifications, variations and constructive combinations of the elements performing the same function in substantially the same manner to achieve the same results, remain within the scope of protection delimited by the appended claims.

The invention claimed is:

1. A gray cast iron alloy presenting a chemical composition with antimony and nitrogen contents, further comprising contents of at least one of the following elements: carbon; phosphorus; silicon; manganese; sulfur; chromium from 0.05 to 0.25% by weight, based on the total weight of the gray cast iron alloy; copper from 0.01 to 0.95% by weight; tin from 0.01 to 0.12% by weight; molybdenum from 0.03 to 0.30% by weight; and iron, where the antimony content ranges from 0.05 to 0.12% by weight and the nitrogen content ranges from 0.008 to 0.013% by weight;

wherein at least the iron and the carbon form a pearlitic matrix with graphite veins; and wherein the antimony and the nitrogen are bound with the iron to stabilize the pearlitic matrix.

2. An internal combustion engine head, characterized in that it is made of gray cast iron alloy, as defined in claim 1.

* * * * *